US010644407B2

(12) United States Patent
Wu et al.

(10) Patent No.: US 10,644,407 B2
(45) Date of Patent: May 5, 2020

(54) COMMUNICATION DEVICE

(71) Applicant: Wistron NeWeb Corp., Hsinchu (TW)

(72) Inventors: Yan-Ting Wu, Hsinchu (TW); Cheng-Da Yang, Hsinchu (TW); Yu-Yu Chiang, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 88 days.

(21) Appl. No.: 16/035,849

(22) Filed: Jul. 16, 2018

(65) Prior Publication Data

US 2019/0221943 A1 Jul. 18, 2019

Related U.S. Application Data

(60) Provisional application No. 62/617,292, filed on Jan. 14, 2018.

(30) Foreign Application Priority Data

Mar. 28, 2018 (TW) ..... 107110710 A

(51) Int. Cl.
*H01Q 1/38* (2006.01)
*H01Q 13/10* (2006.01)
(Continued)

(52) U.S. Cl.
CPC ..... *H01Q 13/103* (2013.01); *H01Q 1/38* (2013.01); *H01Q 5/371* (2015.01); *H01Q 5/385* (2015.01);
(Continued)

(58) Field of Classification Search
CPC ..... H01Q 1/38; H01Q 13/103; H01Q 5/371; H01Q 5/385; H01Q 13/106; H01Q 13/16
(Continued)

(56) References Cited

U.S. PATENT DOCUMENTS 8,599,084 B2 * 12/2013 Wong ..... H01Q 1/243 343/749
9,325,059 B2 * 4/2016 Wong ..... H01Q 1/243
(Continued)

FOREIGN PATENT DOCUMENTS

TW 201401645 A 1/2014
TW 201703350 A 1/2017
TW 201735444 A 10/2017

*Primary Examiner* — Huedung X Mancuso
(74) *Attorney, Agent, or Firm* — McClure, Qualey & Rodack, LLP

(57) ABSTRACT

A communication device includes a metal mechanism element, a feeding radiation element, a tuning radiation element, and a dielectric substrate. The metal mechanism element has a closed slot. The feeding radiation element extends across the closed slot. The feeding radiation element has a feeding point. The tuning radiation element extends across the closed slot. The first end of the tuning radiation element is coupled to the metal mechanism element. The second end of the tuning radiation element is adjacent to the metal mechanism element or is coupled to the metal mechanism element. The dielectric substrate is adjacent to the metal mechanism element. The feeding radiation element and the tuning radiation element are both disposed on the dielectric substrate. An antenna structure is formed by the feeding radiation element, the tuning radiation element, and the closed slot of the metal mechanism element.

19 Claims, 5 Drawing Sheets

(51) Int. Cl.

| | |
|---|---|
| ***H01Q 13/16*** | (2006.01) |
| ***H01Q 5/385*** | (2015.01) |
| ***H01Q 5/371*** | (2015.01) |
| *H01Q 1/22* | (2006.01) |
| *H01Q 1/24* | (2006.01) |

(52) U.S. Cl.
CPC ..... *H01Q 13/106* (2013.01); *H01Q 13/16* (2013.01); *H01Q 1/2258* (2013.01); *H01Q 1/243* (2013.01)

(58) Field of Classification Search
USPC ..... 353/700 MS
See application file for complete search history.

(56) References Cited

U.S. PATENT DOCUMENTS

| | | | | |
|---|---|---|---|---|
| 2008/0303729 | A1* | 12/2008 | Milosavljevic ..... | H01Q 1/243 343/722 |
| 2010/0289700 | A1* | 11/2010 | Yang ..... | H01Q 9/0421 343/700 MS |
| 2012/0013511 | A1 | 1/2012 | Sumi et al. | |
| 2013/0342408 | A1 | 12/2013 | Chang et al. | |
| 2014/0071005 | A1* | 3/2014 | Wang ..... | H01Q 1/243 343/725 |
| 2017/0005414 | A1 | 1/2017 | Yang | |

* cited by examiner

COMMUNICATION DEVICE

CROSS REFERENCE TO RELATED APPLICATIONS

This application claims the benefit of U.S. Provisional Application No. 62/617,292, filed on Jan. 14, 2018, the entirety of which is incorporated by reference herein. This application further claims priority of Taiwan Patent Application No. 107110710 filed on Mar. 28, 2018, the entirety of which is incorporated by reference herein.

BACKGROUND OF THE INVENTION

Field of the Invention

The disclosure generally relates to a communication device, and more particularly, it relates to a communication device and an antenna structure therein.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

In order to improve their appearance, designers often incorporate metal elements into mobile devices. However, the newly added metal elements tend to negatively affect the antennas used for wireless communication in mobile devices, thereby degrading the overall communication quality of the mobile devices. As a result, there is a need to propose a mobile device with a novel antenna structure, so as to overcome the problems of the prior art.

BRIEF SUMMARY OF THE INVENTION

In an exemplary embodiment, the disclosure is directed to a communication device including a metal mechanism element, a feeding radiation element, a tuning radiation element, and a dielectric substrate. The metal mechanism element has a closed slot. The feeding radiation element extends across the closed slot. The feeding radiation element has a feeding point. The tuning radiation element extends across the closed slot. A first end of the tuning radiation element is coupled to the metal mechanism element. A second end of the tuning radiation element is adjacent to the metal mechanism element or is coupled to the metal mechanism element. The dielectric substrate is adjacent to the metal mechanism element. The feeding radiation element and the tuning radiation element are both disposed on the dielectric substrate. An antenna structure is formed by the feeding radiation element, the tuning radiation element, and the closed slot of the metal mechanism element.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
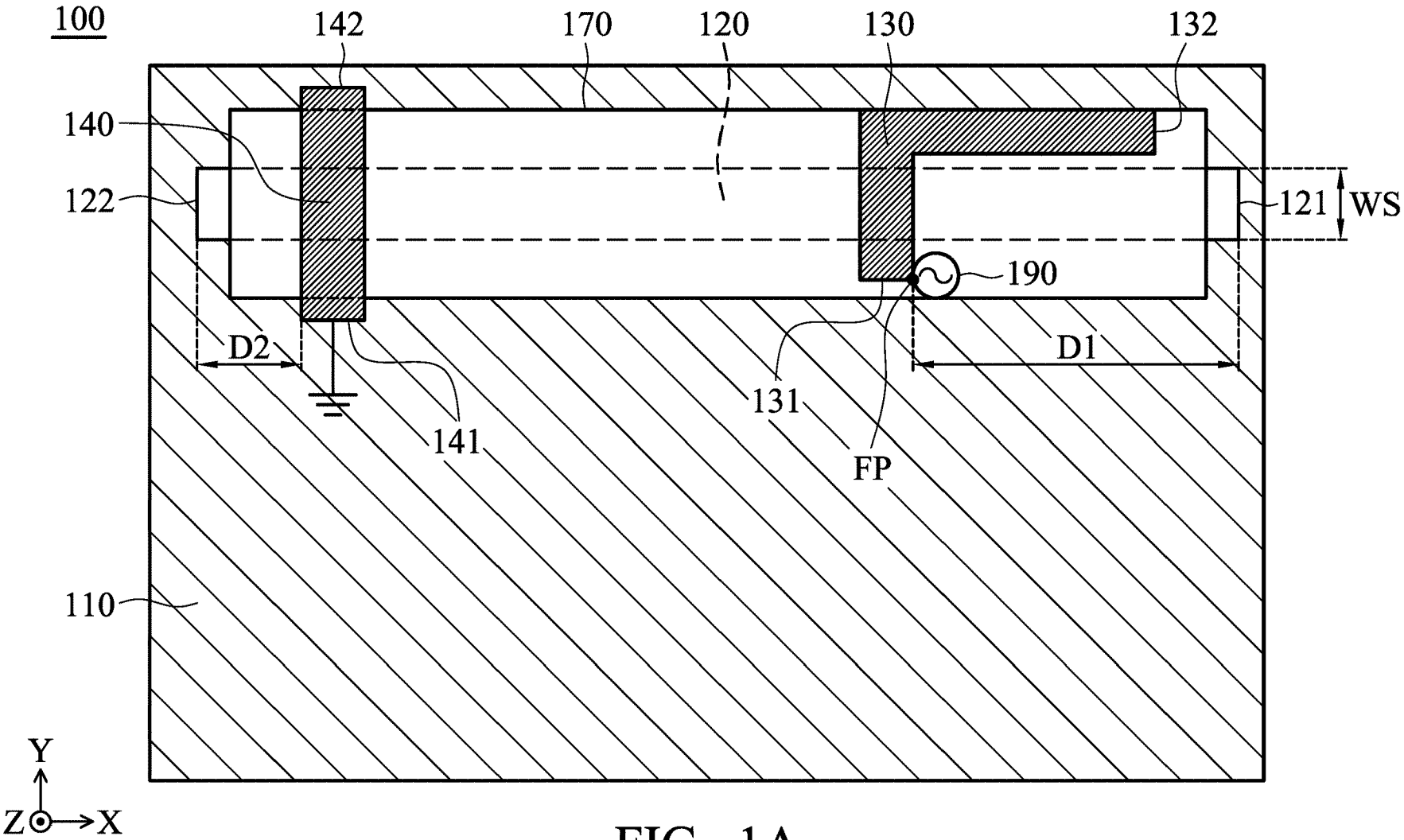
FIG. 1A is a top view of a communication device according to an embodiment of the invention.
Figure 1B:
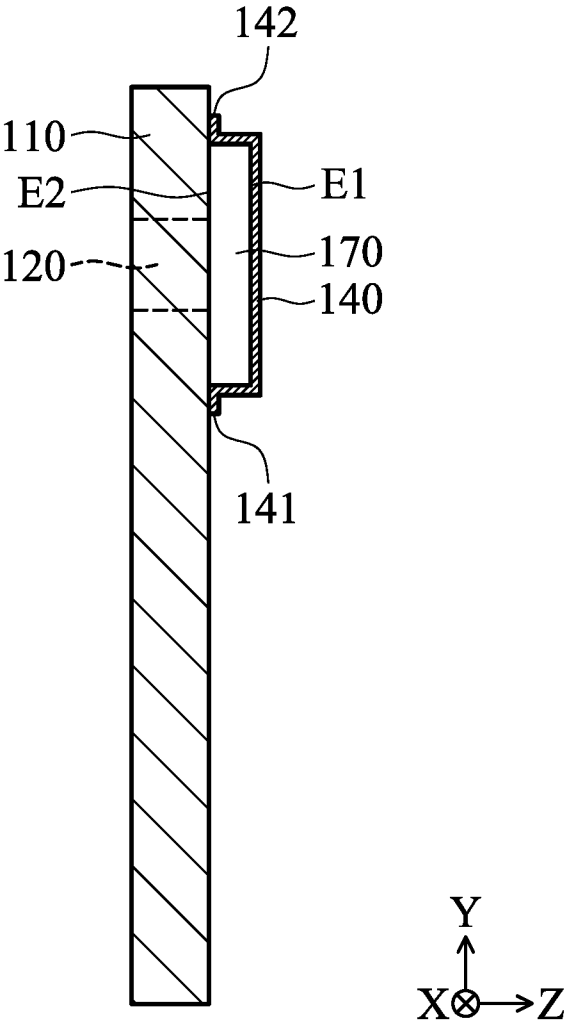
FIG. 1B is a side view of a communication device according to an embodiment of the invention.

FIG. 1A is a top view of a communication device 100 according to an embodiment of the invention. FIG. 1B is a side view of the communication device 100 according to an embodiment of the invention. Please refer to FIG. 1A and FIG. 1B together. For example, the communication device 100 may be a smartphone, a tablet computer, or a notebook computer, but it is not limited thereto. In the embodiment of FIG. 1A and FIG. 1B, the communication device 100 includes a metal mechanism element 110, a feeding radiation element 130, a tuning radiation element 140, and a dielectric substrate 170. It should be understood that the communication device 100 may further include other components, such as a processor, a touch control panel, a speaker, a battery module, and a housing, although they are not displayed in FIG. 1A and FIG. 1B.

The metal mechanism element 110 may be a metal back cover of the communication device 100. The metal mechanism element 110 may be classified as a decorative appearance element for providing a ground voltage (e.g., 0V). The so-called "decorative appearance element" means the element which is disposed on the communication device 100 and can be directly observed by eyes of a user. The metal mechanism element 110 has a closed slot 120. Specifically, the closed slot 120 substantially has a straight-line shape with a first closed end 121 and a second closed end 122 which are away from each other. However, the invention is not limited thereto. In other embodiments, adjustments are made to replace the closed slot 120 with an open slot. The open slot may also substantially have a straight-line shape with an open end and a closed end which are away from each other.

The feeding radiation element 130 and the tuning radiation element 140 are made of metal materials, such as copper, silver, aluminum, iron, or their alloys. The dielectric substrate 170 may be an FR4 (Flame Retardant 4) substrate, a PCB (Printed Circuit Board), or an FCB (Flexible Circuit Board). The dielectric substrate 170 has a first surface E1 and a second surface E2 which are opposite to each other. The feeding radiation element 130 and the tuning radiation element 140 are both disposed on the first surface E1 of the dielectric substrate 170. The second surface E2 of the dielectric substrate 170 may be adjacent to the metal mechanism element 110, or may be directly affixed to the metal mechanism element 110 (the second surface E2 may be adjacent to the closed slot 120 or may touch the closed slot 120). It should be noted that the term "adjacent" or "close" over the disclosure means that the distance (spacing) between two corresponding elements is smaller than a predetermined distance (e.g., 1 mm or the shorter), or means that the two corresponding elements directly touch each other (i.e., the aforementioned distance/spacing therebetween is reduced to 0).

The feeding radiation element 130 may substantially have an L-shape. The feeding radiation element 130 has a feeding point FP, which is coupled to a signal source 190 of the communication device 100. The signal source 190 may be an RF (Radio Frequency) module for generating a transmission signal or processing a reception signal. Specifically, the feeding radiation element 130 has a first end 131 and a second end 132. The feeding point FP is positioned at the first end 131 of the feeding radiation element 130. The second end 132 of the feeding radiation element 130 is an open end. The feeding radiation element 130 extends across the closed slot 120 of the metal mechanism element 110. The second end 132 of the feeding radiation element 130 extends away from the tuning radiation element 140. That is, the feeding radiation element 130 has a vertical projection on the metal mechanism element 110, and such a vertical projection at least partially overlaps the closed slot 120. For example, the vertical projection of the feeding radiation element 130 may be across a portion of the width WS of the closed slot 120, or across the whole width WS of the closed slot 120.

The tuning radiation element 140 may substantially have a straight-line shape. The tuning radiation element 140 extends across the closed slot 120 of the metal mechanism element 110. That is, the tuning radiation element 140 has a vertical projection on the metal mechanism element 110, and such a vertical projection at least partially overlaps the closed slot 120. For example, the vertical projection of the tuning radiation element 140 may be across a portion of the width WS of the closed slot 120, or across the whole width WS of the closed slot 120. Specifically, the tuning radiation element 140 has a first end 141 and a second end 142. The first end 141 of the tuning radiation element 140 is coupled to (or directly connected to) the metal mechanism element 110. The second end 142 of the tuning radiation element 140 is adjacent to the metal mechanism element 110, or is coupled to (or directly connected to) the metal mechanism element 110. Please refer to FIG. 1B. The tuning radiation element 140 can extend from the first surface E1 of the dielectric substrate 170 onto the metal mechanism element 110, such that both of the first end 141 and the second end 142 of the tuning radiation element 140 can directly touch the metal mechanism element 110. In alternative embodiments, only the first end 141 of the tuning radiation element 140 directly touches the metal mechanism element 110, and there is an isolation layer for separating the metal mechanism element 110 from the second end 142 of the tuning radiation element 140, such that a very narrow coupling gap is formed between the metal mechanism element 110 and the second end 142 of the tuning radiation element 140. The width of the coupling gap may be shorter than 0.01 mm.

It should be noted that an antenna structure is formed by the feeding radiation element 130, the tuning radiation element 140, and the closed slot 120 of the metal mechanism element 110. According to the practical measurement, when receiving or transmitting wireless signals, the antenna structure covers a low-frequency band from about 790 MHz to about 890 MHz, and a high-frequency band from about 1830 MHz to about 2690 MHz. Therefore, the antenna structure of the communication device 100 can support at least the wideband operation of LTE (Long Term Evolution).

In some embodiments, the antenna structure of the communication device 100 has the following operation principles. The feeding radiation element 130 and the closed slot 120 of the metal mechanism element 110 are excited to generate the aforementioned low-frequency band. The feeding radiation element 130 is independently excited to generate the aforementioned high-frequency band. The tuning radiation element 140 is configured to fine-tune the low-frequency impedance matching of the antenna structure, thereby decreasing the lowest operation frequency of the antenna structure and increasing the operation bandwidth of the antenna structure. With such a design, the length of the closed slot 120 of the metal mechanism element 110 (i.e., the length from the first closed end 121 to the second closed end 122) can be shorter than 0.5 wavelength ($\lambda/2$) of the central frequency of the aforementioned low-frequency band, so as to minimize the total size of the communication device 100 and its antenna structure.

In some embodiments, the communication device 100 has the following element sizes. The distance D1 between the feeding point FP and the first closed end 121 of the closed slot 120 may be from about 40 mm to about 45 mm. The distance D2 between the tuning radiation element 140 and the second closed end 122 of the closed slot 120 may be from about 0.5 mm to about 38 mm. The length of the closed slot 120 may be from about 0.25 to 0.5 wavelength ($\lambda 4 \sim \lambda/2$) of the central frequency of the aforementioned low-frequency band. The length of the feeding radiation element 130 (i.e., the length from the first end 131 to the second end 132) may be substantially equal to 0.25 wavelength ($\lambda/4$) of the central frequency of the aforementioned high-frequency band. The length of the tuning radiation element 140 (i.e., the length from the first end 141 to the second end 142) may be longer than the width WS of the closed slot 120. The above ranges of element sizes are calculated and obtained according to many experiment results, and they can help to optimize the operation bandwidth and the impedance matching of the antenna structure of the communication device 100.

Figure 2:
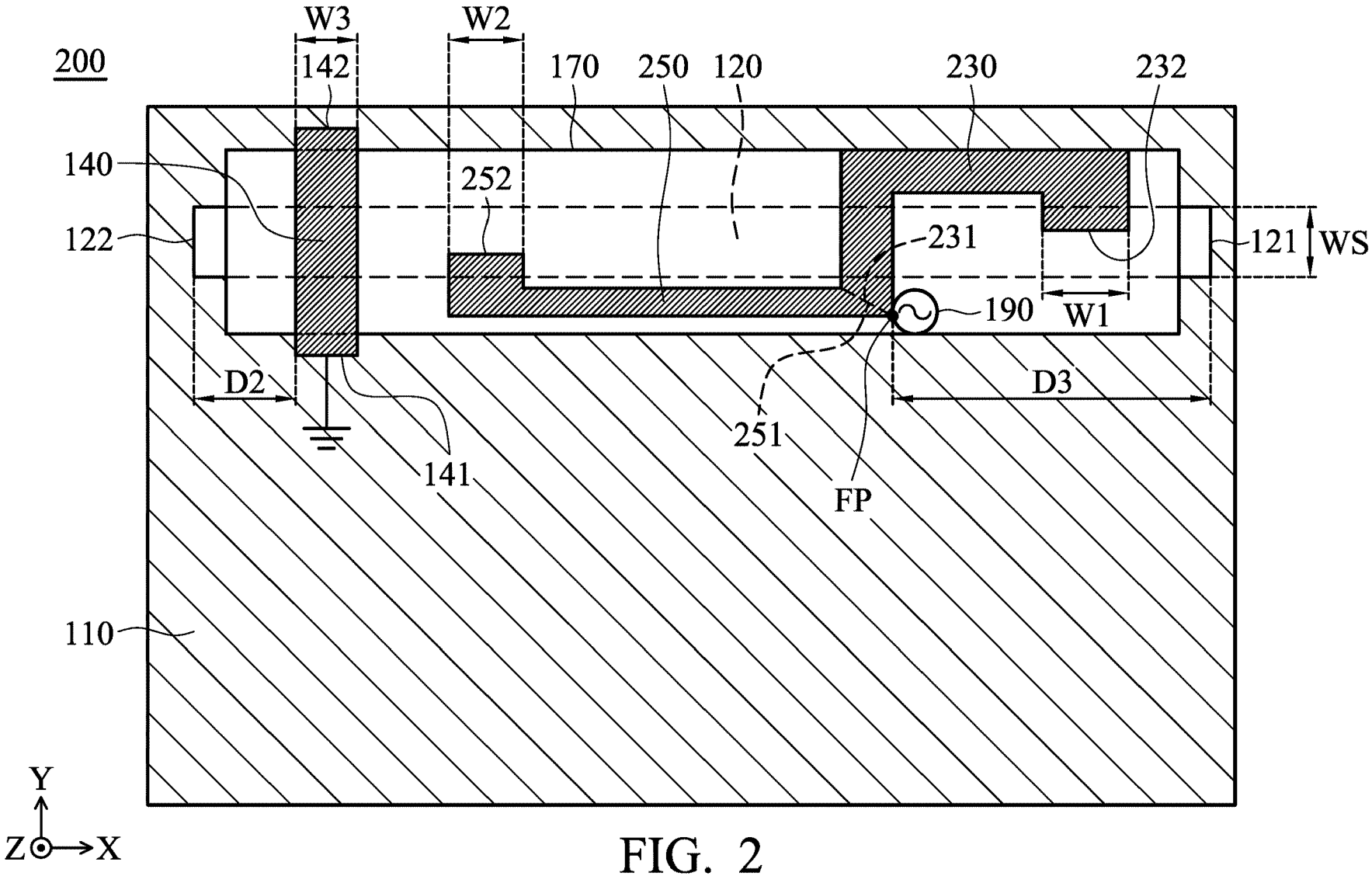
FIG. 2 is a top view of a communication device according to an embodiment of the invention.

FIG. 2 is a top view of a communication device 100 according to an embodiment of the invention. FIG. 2 is similar to FIG. 1A. In the embodiment of FIG. 2, the communication device 200 further includes a feeding radiation element 230 and a feeding extension element 250. The feeding radiation element 230 and the feeding extension element 250 are made of metal materials, and they are both disposed on the dielectric substrate 170. An antenna structure is formed by the feeding radiation element 230, the feeding extension element 250, the tuning radiation element 140, and the closed slot 120 of the metal mechanism element 110. A combination of the feeding radiation element 230 and the feeding extension element 250 may substantially have an S-shape. Specifically, the feeding radiation element 230 may substantially have a J-shape with a first end 231 and a second end 232. The first end 231 of the feeding radiation element 230 is coupled to the feeding point FP, and the second end 232 of the feeding radiation element 230 is an open end. The feeding extension element 250 may substantially have an L-shape with a first end 251 and a second end 252. The first end 251 of the feeding extension element 250 is coupled to the feeding point FP, and the second end 252 of the feeding extension element 250 is an open end. It should be noted that the second end 232 of the feeding radiation element 230 and the second end 252 of the feeding extension element 250 have vertical projections on the metal mechanism element 110, and such vertical projections are inside the closed slot 120. According to the practical measurement, if the second end 232 of the feeding radiation element 230 and the second end 252 of the feeding extension element 250 are both completely surrounded by the closed slot 120, the impedance matching of the antenna structure of the communication device 200 can be optimized, and the operation bandwidth of the antenna structure can be increased. In some embodiments, the S-shape formed by the combination of the feeding radiation element 230 and the feeding extension element 250 has a width-varying structure. For example, the width W1 of the second end 232 of the feeding radiation element 230 may be longer than the width W2 of the second end 252 of the feeding extension element 250, and the width W2 of the second end 252 of the feeding extension element 250 may be longer than the width W3 of the tuning radiation element 140 (i.e., W1>W2>W3). This width-varying structure can fine-tune the resonant length and the operation frequency of the antenna structure of the communication device 200. For example, if any of the widths W1, W2 and W3 increases, the operation frequency of the antenna structure of the communication device 200 will shift and becomes lower, and if any of the widths W1, W2 and W3 decreases, the operation frequency of the antenna structure of the communication device 200 will shift and becomes higher. However, the invention is not limited thereto. In other embodiments, adjustments are made such that the S-shape formed by the combination of the feeding radiation element 230 and the feeding extension element 250 has an equal-width structure (i.e., W1=W2=W3).

Figure 3:
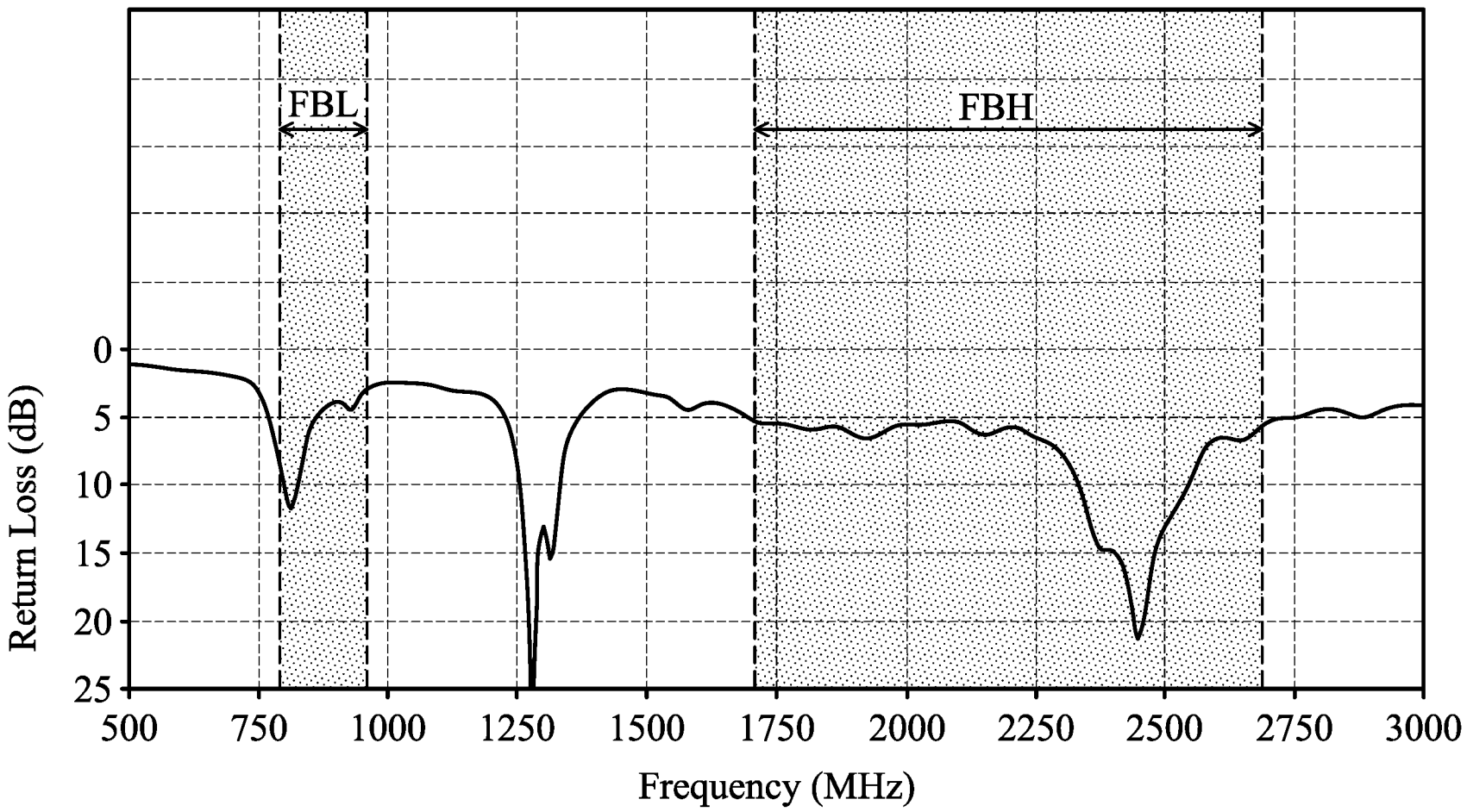
FIG. 3 is a diagram of return loss of an antenna structure of a communication device according to an embodiment of the invention.

FIG. 3 is a diagram of return loss of the antenna structure of the communication device 200 according to an embodiment of the invention. The horizontal axis represents the operation frequency (MHz), and the vertical axis represents the return loss (dB). According to the measurement of FIG. 3, when receiving or transmitting wireless signals, the antenna structure of the communication device 200 covers a low-frequency band FBL from about 790 MHz to about 960 MHz, and a high-frequency band FBH from about 1710 MHz to about 2690 MHz. Therefore, the antenna structure of the communication device 200 can support at least the wideband operation of LTE.

In the embodiment of FIG. 2, the antenna structure of the communication device 200 has operation principles and element sizes as follows. The feeding radiation element 230 and the closed slot 120 of the metal mechanism element 110 are excited to generate a first frequency interval from 790 MHz to 890 MHz within the low-frequency band FBL. The feeding radiation element 230 is independently excited to generate a second frequency interval from 1830 MHz to 2690 MHz within the high-frequency band FBH. In addition, the feeding extension element 250 and the closed slot 120 of the metal mechanism element 110 are excited to generate a third frequency interval from 890 MHz to 960 MHz within the low-frequency band FBL, and a fourth frequency interval from 1710 MHz to 1830 MHz within the high-frequency band FBH. As a result, the incorporation of the feeding extension element 250 can help to increase both the bandwidths of the low-frequency band FBL and the high-frequency band FBH of the antenna structure of the communication device 200 (in comparison to the embodiment of FIG. 1A and FIG. 1B, the low-frequency band FBL further includes the third frequency interval, and the high-frequency band FBH further includes the fourth frequency interval). With respect to the element sizes, the distance D3 between the feeding point FP and the first closed end 121 of the closed slot 120 may be from about 40 mm to about 45 mm. The distance D2 between the tuning radiation element 140 and the second closed end 122 of the closed slot 120 may be from about 0.5 mm to about 38 mm. The length of the closed slot 120 (i.e., the length from the first closed end 121 to the second closed end 122) may be from about 0.25 to 0.5 wavelength ($\lambda/4$~$\lambda/2$) of the central frequency of the low-frequency band FBL. The length of the feeding radiation element 230 (i.e., the length from the first end 231 to the second end 232) may be substantially equal to 0.25 wavelength ($\lambda/4$) of the central frequency of the high-frequency band FBH. The length of the feeding extension element 250 (i.e., the length from the first end 251 to the second end 252) may be substantially equal to 0.25 wavelength ($\lambda/4$) of the central frequency of the low-frequency band FBL. Other features of the communication device 200 of FIG. 2 are similar to those of the communication device 100 of FIG. 1A and FIG. 1B. Therefore, the two embodiments can achieve similar levels of performance.

Figure 4:
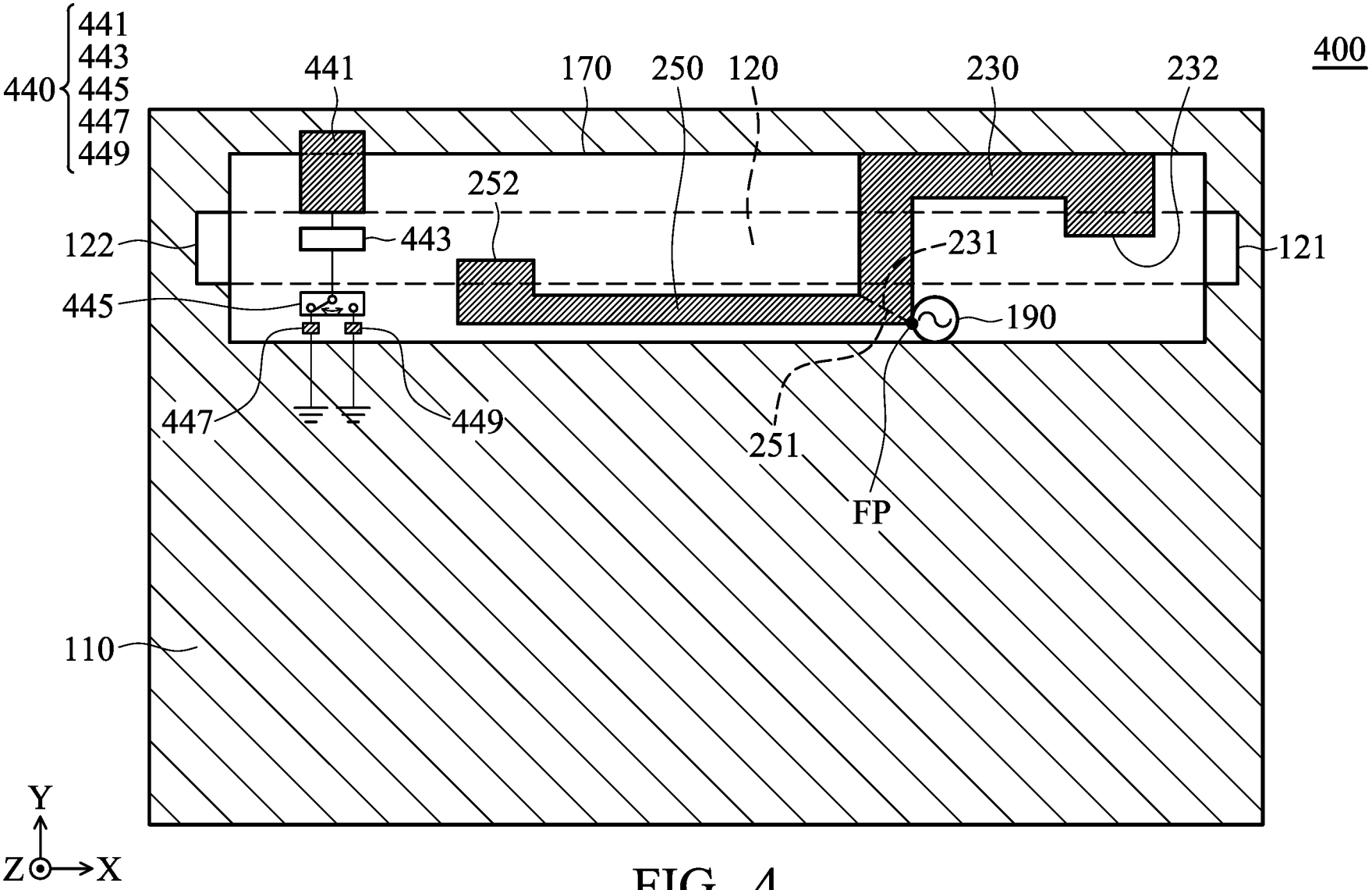
FIG. 4 is a top view of a communication device according to an embodiment of the invention.

FIG. 4 is a top view of a communication device 400 according to an embodiment of the invention. FIG. 4 is similar to FIG. 2. In the embodiment of FIG. 4, a tuning radiation element 440 of the communication device 400 includes a metal portion 441, a circuit element 443, a switch element 445, and a plurality of impedance elements 447 and 449. The circuit element 443, the switch element 445, and the impedance elements 447 and 449 are all disposed on the dielectric substrate 170. The metal portion 441 is adjacent to the metal mechanism element 110, or is coupled to (or directly connected to) the metal mechanism element 110. The circuit element 443 is coupled between the metal portion 441 and the switch element 445. For example, the circuit element 443 may be a resistor, a capacitor, or an inductor. The circuit element 443 has a vertical projection on the metal mechanism element 110, and such a vertical projection is inside the closed slot 120. The impedance elements 447 and 449 have different impedance values. For example, any of the impedance elements 447 and 449 may be a resistor, a capacitor, or an inductor. The switch element 445 can select one of the impedance elements 447 and 449 according to a control signal, such that the metal portion 441 and the circuit element 443 are coupled through the selected impedance element to a ground voltage (i.e., the metal mechanism element 110). The aforementioned control signal may be generated by a processor according to a user's input. The switch element 445 and the impedance elements 447 and 449 have vertical projections on the metal mechanism element 110, and such vertical projections are outside the closed slot 120. By controlling the switch element 445 to switch between the impedance elements 447 and 449, the tuning radiation element 440 can dynamically change the impedance matching of the antenna structure of the communication device 400, so as to further increase the operation bandwidth of the antenna structure. According to the practical measurement, the aforementioned positions of the circuit element 443, the switch element 445, and the impedance elements 447 and 449 (inside or outside the closed slot 120) can prevent these elements from seriously interfering with the radiation pattern of the antenna structure of the communication device 400. Although FIG. 4 displays only two impedance elements 447 and 449, in other embodiments, the tuning radiation element 440 may include three or more impedance elements in response to different requirements. Other features of the communication device 400 of FIG. 4 are similar to those of the communication device 100 of FIG. 1A and FIG. 1B. Therefore, the two embodiments can achieve similar levels of performance.

The invention proposes a novel antenna structure including the design of a slot and a tuning radiation element. When the antenna structure is applied to a communication device with a metal mechanism element, it effectively prevents the metal mechanism element from negatively affecting the communication quality of the communication device because the metal mechanism element is considered as an extension portion of the antenna structure. The incorporation of the tuning radiation element can decrease the operation frequency of the antenna structure, and increase the operation bandwidth of the antenna structure. It should be also noted that the invention can improve the appearance and design of the communication device, without opening any antenna windows on the metal mechanism element. In conclusion, the invention has the advantages of small size, wide bandwidth, and beautiful device appearance, and therefore it is suitable for application in a variety of mobile communication devices.

Note that the above element sizes, element shapes, and frequency ranges are not limitations of the invention. An antenna designer can fine-tune these settings or values according to different requirements. It should be understood that the communication device and antenna structure of the invention are not limited to the configurations of FIGS. 1-4. The invention may merely include any one or more features of any one or more embodiments of FIGS. 1-4. In other words, not all of the features displayed in the figures should be implemented in the communication device and antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A communication device, comprising:

a metal mechanism element, having a closed slot;

a feeding radiation element, extending across the closed slot, wherein the feeding radiation element has a feeding point;

a tuning radiation element, extending across the closed slot, wherein a first end of the tuning radiation element is coupled to the metal mechanism element, and a second end of the tuning radiation element is adjacent to or is coupled to the metal mechanism element; and a dielectric substrate, disposed adjacent to the metal mechanism element, wherein the feeding radiation element and the tuning radiation element are disposed on the dielectric substrate;

wherein an antenna structure is formed by the feeding radiation element, the tuning radiation element, and the closed slot of the metal mechanism element;

wherein the communication device further comprises:

a feeding extension element, wherein a first end of the feeding radiation element and a first end of the feeding extension element are coupled to the feeding point, and wherein a second end of the feeding radiation element and a second end of the feeding extension element are open ends.

2. The communication device as claimed in claim 1, wherein the feeding radiation element substantially has an L-shape.

3. The communication device as claimed in claim 1, wherein the tuning radiation element substantially has a straight-line shape.

4. The communication device as claimed in claim 1, wherein the closed slot substantially has a straight-line shape with a first closed end and a second closed end.

5. The communication device as claimed in claim 4, wherein a distance between the feeding point and the first closed end is from 40 mm to 45 mm.

6. The communication device as claimed in claim 4, wherein a distance between the tuning radiation element and the second closed end is from 0.5 mm to 38 mm.

7. The communication device as claimed in claim 1, wherein the antenna structure covers a low-frequency band from 790 MHz to 890 MHz, and a high-frequency band from 1830 MHz to 2690 MHz.

8. The communication device as claimed in claim 7, wherein a length of the closed slot is from 0.25 to 0.5 wavelength of a central frequency of the low-frequency band.

9. The communication device as claimed in claim 7, wherein a length of the feeding radiation element is substantially equal to 0.25 wavelength of a central frequency of the high-frequency band.

10. The communication device as claimed in claim 1, wherein a combination of the feeding radiation element and the feeding extension element substantially has an S-shape.

11. The communication device as claimed in claim 10, wherein the S-shape has a width-varying structure.

12. The communication device as claimed in claim 1, wherein the second end of the feeding radiation element and the second end of the feeding extension element have vertical projections on the metal mechanism element, and the vertical projections are inside the closed slot.

13. The communication device as claimed in claim 1, wherein the antenna structure covers a low-frequency band from 790 MHz to 960 MHz, and a high-frequency band from 1710 MHz to 2690 MHz.

14. The communication device as claimed in claim 13, wherein a length of the feeding extension element is substantially equal to 0.25 wavelength of a central frequency of the low-frequency band.

15. The communication device as claimed in claim 1, wherein the tuning radiation element comprises:

a metal portion, disposed adjacent to or coupled to the metal mechanism element;

a circuit element;

a switch element, wherein the circuit element is coupled between the metal portion and the switch element; and a plurality of impedance elements, having different impedance values, wherein the switch element selects one of the impedance elements, such that the metal portion and the circuit element are coupled through the selected impedance element to the metal mechanism element.

16. The communication device as claimed in claim 15, wherein the circuit element has a vertical projection on the metal mechanism element, and the vertical projection is inside the closed slot.

17. The communication device as claimed in claim 15, wherein the circuit element is a resistor, a capacitor, or an inductor.

18. The communication device as claimed in claim 15, wherein the switch element and the impedance elements have vertical projections on the metal mechanism element, and the vertical projections are outside the closed slot.

19. The communication device as claimed in claim 15, wherein any of the impedance elements is a resistor, a capacitor, or an inductor.

* * * * *